US005219042A

United States Patent [19]

Sattar et al.

[11] Patent Number: 5,219,042

[45] Date of Patent: Jun. 15, 1993

[54] USING FUZZY LOGIC TO DETERMINE THE NUMBER OF PASSENGERS ENTERING AND EXITING AN ELEVATOR CAR

[75] Inventors: Siddiq A. Sattar, Avon; John K. Mizon, West Hartford; David J. Sirag, Jr., South Windsor, all of Conn.

[73] Assignee: Otis Elevator Company, Farmington, Conn.

[21] Appl. No.: 808,864

[22] Filed: Dec. 17, 1991

[51] Int. Cl.[5] ..... B66B 1/18; B66B 1/44

[52] U.S. Cl. ..... 187/127; 187/132

[58] Field of Search ..... 187/127, 132, 125; 364/200 MS File, 900 MS File, 424.01; 395/910

[56] References Cited

U.S. PATENT DOCUMENTS 4,044,860 8/1977 Kaneko et al. ..... 187/132
4,536,842 8/1985 Yoneda et al. ..... 364/424
4,760,896 8/1988 Yamaguchi ..... 187/127
4,947,965 8/1990 Kuzunuki et al. ..... 187/127
5,022,498 6/1991 Sasaki et al. ..... 187/127

*Primary Examiner*—A. D. Pellinen
*Assistant Examiner*—David Osborn

[57] ABSTRACT

Embedded elevator control software, responsive to WEIGHT, CARCALLS, HALLCALLS and STOPS signals, uses fuzzy logic to determine the number of passengers entering and exiting an elevator car at a stop. The software forms three fuzzy logic sets representing temporary estimates of the number of entering passengers and forms three fuzzy logic sets indicative of temporary estimates of the number of exiting passengers. The sets are combined to form a single fuzzy logic set indicative of the number of entering passengers and a single fuzzy logic set indicative of the number of exiting passengers.

4 Claims, 5 Drawing Sheets

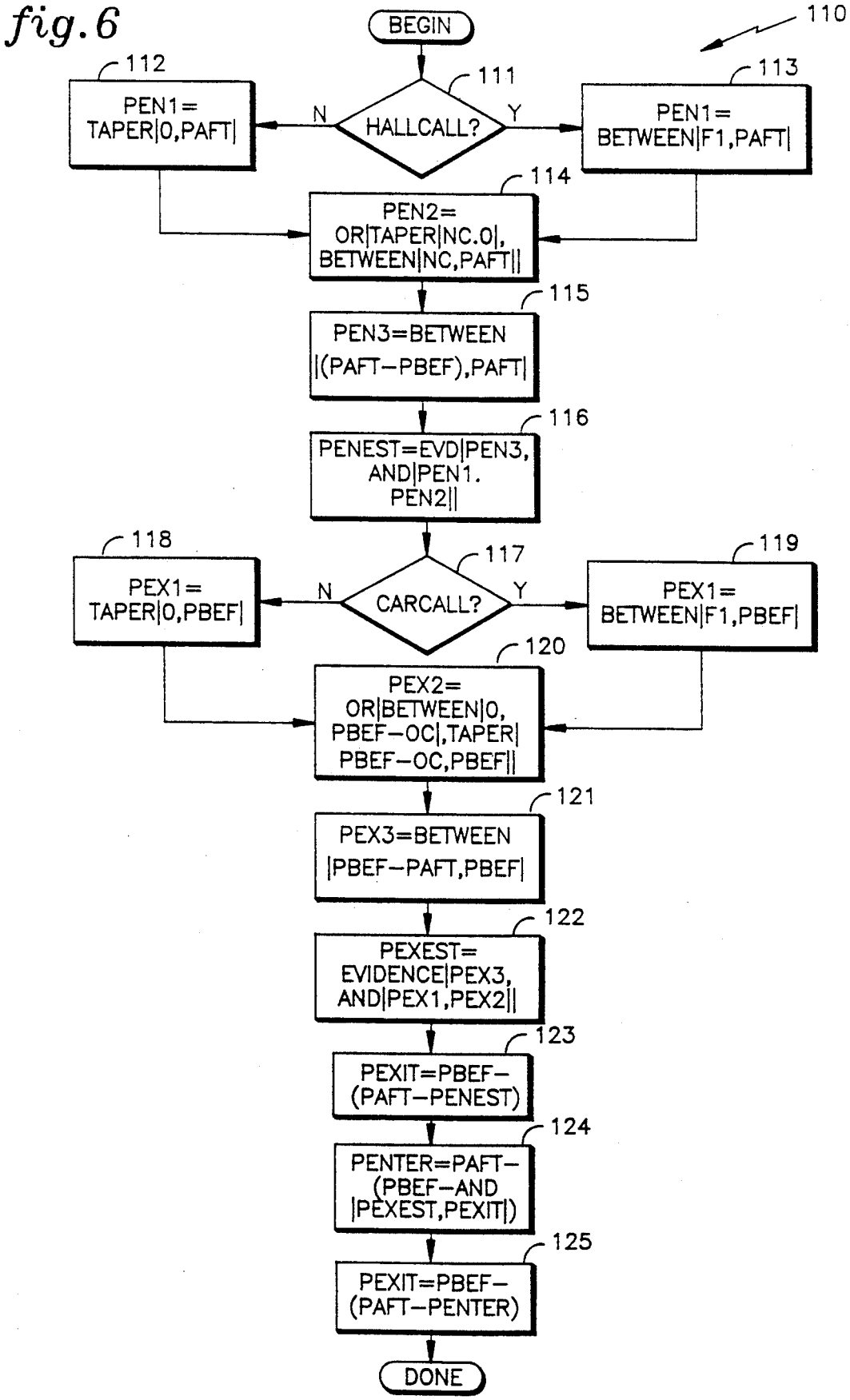
fig. 6
110
BEGIN
111
HALLCALL?
N
Y
112
PEN1=
TAPER|0,PAFT|
113
PEN1=
BETWEEN|F1,PAFT|
114
PEN2=
OR|TAPER|NC.0|,
BETWEEN|NC,PAFT||
115
PEN3=BETWEEN
|(PAFT−PBEF),PAFT|
116
PENEST=EVD|PEN3,
AND|PEN1.
PEN2||
117
CARCALL?
N
Y
118
PEX1=
TAPER|0,PBEF|
119
PEX1=
BETWEEN|F1,PBEF|
120
PEX2=
OR|BETWEEN|0,
PBEF−OC|,TAPER|
PBEF−OC,PBEF||
121
PEX3=BETWEEN
|PBEF−PAFT,PBEF|
122
PEXEST=
EVIDENCE|PEX3,
AND|PEX1,PEX2||
123
PEXIT=PBEF−
(PAFT−PENEST)
124
PENTER=PAFT−
(PBEF−AND
|PEXEST,PEXIT|)
125
PEXIT=PBEF−
(PAFT−PENTER)
DONE

USING FUZZY LOGIC TO DETERMINE THE NUMBER OF PASSENGERS ENTERING AND EXITING AN ELEVATOR CAR

DESCRIPTION

1. Technical Field

This invention relates to the field of elevators and more particularly to the field of elevator control software.

2. Background Art

The use of advanced elevator dispatching algorithms (such as shown in commonly owned U.S. Pat. Nos. 4,846,311; 5,024,295; and 5,035,302) requires accurate information indicative of the number of passengers entering and exiting an elevator car at each stop. A weight sensor in the car can generate a signal indicative of the weight of the passengers and hence can be used to determine the number of passengers.

For various reasons, it is impractical or impossible to accurately measure the weight of passengers while the car is loading or unloading at a stop. Although it is possible to determine the number of passengers in the car either before or after the stop, these quantities cannot be used to directly determine the number of passengers exiting and entering at a stop since the weight increase of entering passengers can be canceled by the weight decrease of exiting passengers.

DISCLOSURE OF INVENTION

Objects of the invention include determining the number of passengers entering and exiting an elevator car at each stop.

According to the present invention, first, second, and third fuzzy logic sets represent temporary estimates of the number of passengers entering an elevator car at a stop wherein said first set depends upon whether the car stops at the floor in response to a hall call, said second set is determined by examining the number of car call buttons which are pressed after the car departs from the stop, and said third set is based upon the number of passengers in the car before the stop and the number of passengers in the car after the stop. According further to the present invention, first, second, and third fuzzy logic sets represent temporary estimates of the number of passengers exiting an elevator car at a stop wherein said first set depends upon whether the car stops at the floor in response to a car call, said second set is determined by examining the number of car call buttons which are pressed before the car reaches the stop, and said third set is based upon the number of passengers in the car before the stop and the number of passengers in the car after the stop.

The foregoing and other objects, features and advantages of the present invention will become more apparent in light of the following detailed description of exemplary embodiments thereof, as illustrated in the accompanying drawings.

BRIEF DESCRIPTION OF DRAWINGS

FIG. 6 is a flowchart illustrating operation of a passenger calculator module for use in the software of FIG. 1.

BEST MODE FOR CARRYING OUT THE INVENTION

Figure 1:
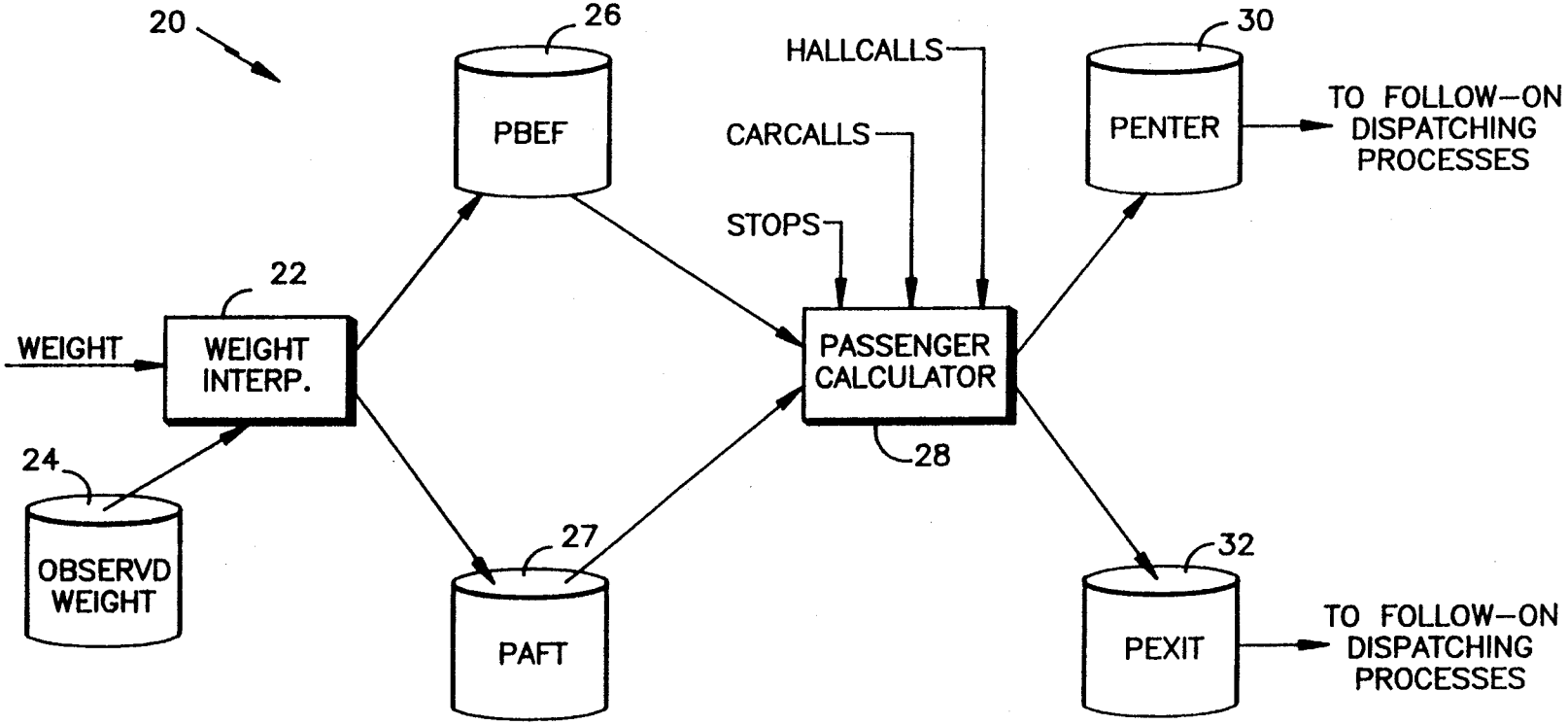
FIG. 1 is a dataflow diagram that illustrates operation of a portion of elevator control software of the invention.

Referring to FIG. 1, a dataflow diagram 20 illustrates operation of a portion of embedded elevator control software for estimating the number of passengers entering an elevator car at a stop, PENTER, and the number of passengers exiting from an elevator car at a stop, PEXIT. Boxes on the diagram 20 indicate program modules (portions of the elevator control software) while cylinders indicate data elements (portions of elevator control data). Arrows between boxes and cylinders indicate the direction of the flow of data. Unlike a flowchart, no portion of the dataflow diagram 20 indicates any temporal relationships between the various modules.

A weight interpretation module 22 is provided with a WEIGHT signal from a weight sensor located in the floor of an elevator car. The magnitude of the weight signal is proportional to the amount of weight resting on the floor of the elevator car. The weight interpretation module 22 also receives input from an observed weight data element 24, which is described in more detail hereinafter. The weight interpretation module 22 uses the WEIGHT signal and the observed weight data element 24 to estimate PBEF and PAFT, estimates of the number of passengers in the elevator car before the stop and after the stop, respectively. The passenger estimate is provided by the weight interpretation module 22 to a PBEF data element 26 if the weight interpretation module 22 is run before a stop. Similarly, the passenger estimate is provided by the weight interpretation module 22 to a PAFT data element 27 if the weight interpretation module 22 is run after a stop. Using the observed weight data element 24 and the WEIGHT signal to estimate the number of car passengers is discussed in more detail hereinafter.

The PBEF and PAFT data elements 26, 27 are provided as inputs to a passenger calculator module 28. A HALLCALLS signal, a CARCALLS signal, and a STOPS signal are also provided as inputs to the passenger calculator module 28. The HALLCALLS signal indicates which hall call buttons have been pressed. Similarly, the CARCALLS signal indicates which car call buttons have been pressed. The STOPS signal provides information indicating a floor at which the elevator car has stopped. Whenever the elevator car stops, the passenger calculator module 28 determines PENTER, the number of passengers entering at the car at the stop, and PEXIT, the number of passengers exiting from the car at the stop. The passenger calculator module 28 stores data indicative of the number of passengers entering the car in a PENTER data element 30 and stores data indicative of the number of passengers exiting the car in a PEXIT data element 32. The PENTER and PEXIT data elements 30, 32 can be accessed by follow-on elevator dispatching processes.

The weight interpretation module 22 transforms the WEIGHT signal into an estimate of the number of car passengers by using fuzzy logic, a branch of mathematics closely related to basic set theory and logic. Fuzzy logic involves using sets having basis elements which are only partially contained therein. For example, whereas a traditional set C may be defined as {X, Y, Z}, a fuzzy set F can be defined as {0.3|X, 0.7|Y, 0.1|Z} wherein the numbers which precede the vertical bars indicate the degree of membership of basis elements X, Y, and Z. The quantity 0.3|X is called a term of the fuzzy set. The basis elements X, Y, and Z can represent numeric or non-numeric quantities. In cases where the basis elements X, Y, and Z represent numbers, basis element or the value of a term, is simply the numerical quantity represented by X, Y, or Z. A crisp value is any value or system of values which does not employ fuzzy logic. A thorough discussion of basic fuzzy logic can be found in Schmucker, K. J., *Fuzzy Sets, Natural Language Computations, and Risk Analysis,* Computer Science Press, Rockville, Maryland, 1984.

A fuzzy logic set can be used to represent a quantity wherein the basis elements indicative of all of the possible values for the quantity and the associated degrees of membership represent the relative likelihood of some event or condition, such as the likelihood that the quantity equals each of the basis values. For example, the number of passengers in an elevator car can be represented as the fuzzy set {0.3|2, 0.5|3, 0.7|4, 0.2|5}, indicating that there is a 0.3 relative likelihood that there are two passengers in the car, a 0.5 relative likelihood that there are three passengers in the car, a 0.7 relative likelihood that there are four passengers in the car, and a 0.2 relative likelihood that there are five passengers in the car.

Although the discussion hereinafter explains implementation details of operation of the fuzzy system, much of the implementation can be automated by tools which translate high level fuzzy logic statements into compilable computer code. One such development tool is the Togai Fuzzy C Development System, manufactured by Togai InfraLogic Inc., of Irvine, California, which converts fuzzy logic statements into compilable C code.

The observed weight data element 24 shown in FIG. 1 can be constructed using generic tables having probabilities and distributions of people's weights. The tabulated data is used to construct a plurality of fuzzy sets that are stored in the observed weight data element 24. Each of the fuzzy sets corresponds to a particular passenger count. For each set, the basis elements correspond to the magnitude of the WEIGHT signal and the degrees of membership of each of the terms represent the frequency of that particular magnitude of the WEIGHT signal with that number of passengers in the car. Each of the sets can be represented as FO(N) where N is a particular passenger count and each element within that set can be represented as FO(N, W) where W is a particular weight, and M=number of occurrences: $FO(N)=\{M_1|W_1, M_2|W_2, \ldots M_jW_j\}$.

Figure 2:
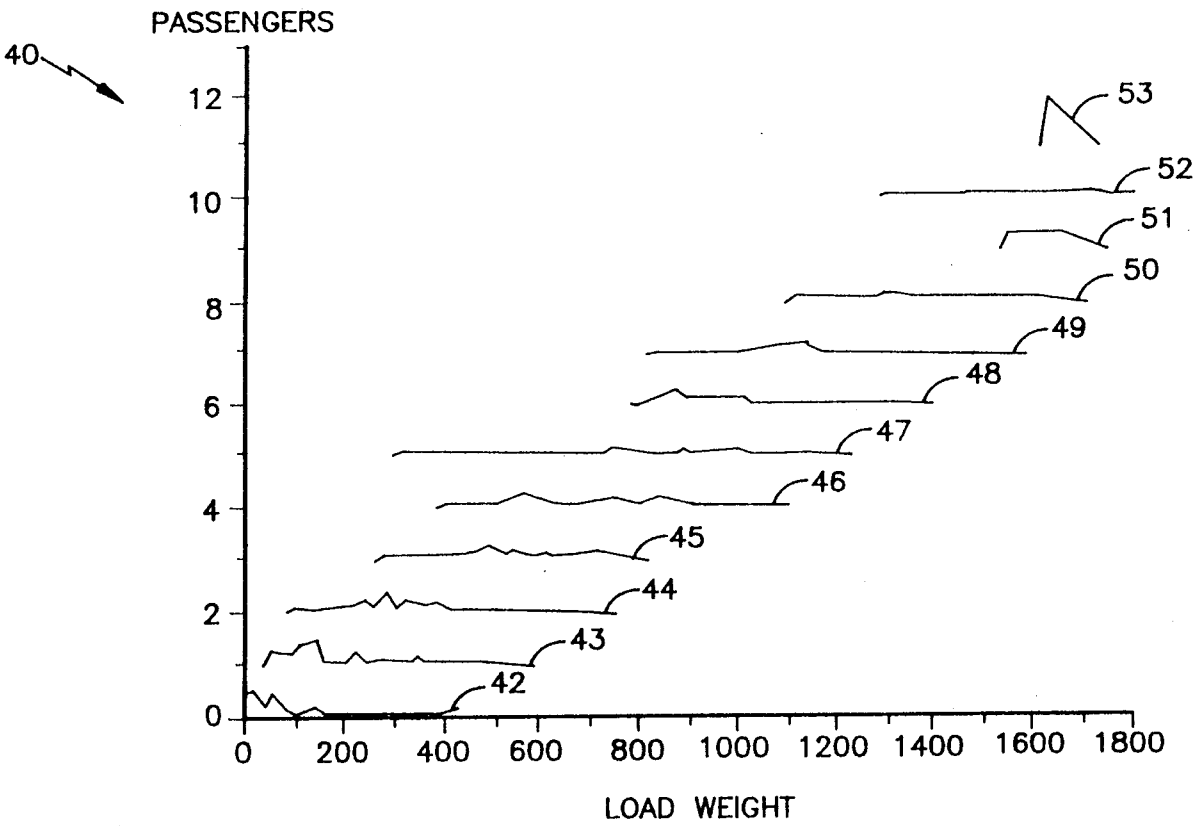
fig.2 prior art
FIG. 2 is a graph illustrating empirically observed elevator weight loading data.

FIG. 2 is a graph 40 illustrating a hypothetical group of histograms of fuzzy sets constructed by tabulating passenger loading (counts) vs. the magnitude of the WEIGHT signal. The graph 40 is comprised of a plurality of plots 42–53 wherein the plot 43 corresponds to the fuzzy set describing the different values of the WEIGHT signal for one passenger, i.e., FO(1), the plot, 44 corresponds to the fuzzy set describing the different values of the WEIGHT signal for two passengers, FO(2), etc. The relative magnitudes of the plots 42–53 indicate the number of times a particular magnitude of the WEIGHT signal is observed and hence indicate the degree of membership of the terms of the fuzzy sets. In fact, each plot has an abscissa of weight and an ordinate (not marked) of some normalized, dimensionless value, such as zero to one, which represent the relative likelihood that such number of passengers provide a weight signal of so many pounds. In a sense then, FIG. 2 is a table of twelve graphs, one per set, for sets relating to 0–11 passengers. Data indicative of the plots 42–53 is stored in the observed weight data element 24.

Figure 3:
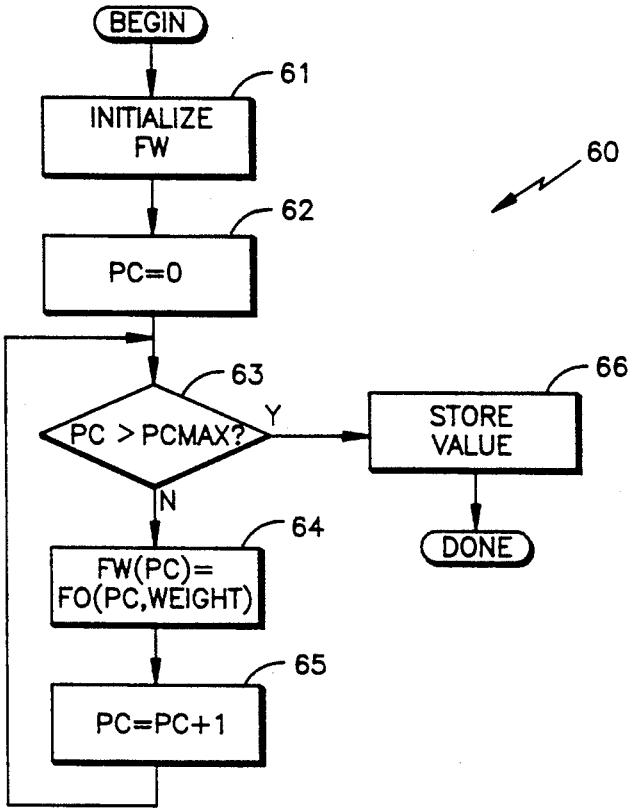
FIG. 3 is a flowchart illustrating operation of a weight interpretation software module for use in the software of FIG 1.

FIG. 3 is a flowchart 60 illustrating some of the operation of the weight interpretation module 22. Processing begins at a first step 61 where a fuzzy set FW(PC) (PC representing a particular passenger count) is initialized to have no terms. Following the step 61 is a step 62 where a variable representing hypothetical passenger counts, PC, is initialized to zero. Following the step 62 is a test step 63 where the value of the variable PC is compared to PCMAX, a predetermined constant value equal to the maximum number of possible car passengers (eleven, in the example of FIG. 2).

If PC is not greater than PCMAX, control passes from the test step 63 to a step 64 where a term, taken from the fuzzy set FO(PC) stored in the observed weight data element 24, is added to the fuzzy set FW. The added term corresponds to a passenger count equal to PC and a weight equal to the magnitude of the current WEIGHT signal; the added term is the membership of the FO(PC, WEIGHT) term a magnitude of 0–1 in FIG. 2). After the step 64 is a step 65 where the PC variable is incremented. The steps 63–65 are repeatedly executed to develop a set, which for 600 pounds might be {0|0, 0.1|1, 0.2|2, 0.3|3, 0.7|4, 0.4|5, 0|6, etc.} for the example of FIG. 2. When PC exceeds PCMAX at the test step 63, control passes from the step 63 to a step 66, where fuzzy set FW, the calculated value of the passenger count, is stored either in the PBEF data element 26 (if the measurement was made before the stop) or in the PAFT data element 27 (if the measurement was made after the stop). The stored fuzzy set FW is, in a sense, an expression of a vertical slice through FIG. 2 at the particular weight sensed (e.g., 600 pounds in the example hereinbefore).

Prior to discussion of the passenger calculator module 28, it is necessary to discuss a variety of non-standard fuzzy logic functions employed by the passenger calculator module 28. One of the non-standard functions is GE[X], which produces a fuzzy set having terms that correspond to values greater than or equal to values of terms of a fuzzy set X wherein the degrees of membership of terms of the GE[X] fuzzy set correspond to the relative likelihood that the value of the associated basis element is greater than or equal to the value of a term of X. Similar non-standard fuzzy logic functions include GT[X], LE[X], and LT[X] which represent greater than X, less than or equal to X, and less than X, respectively.

Figure 4A:
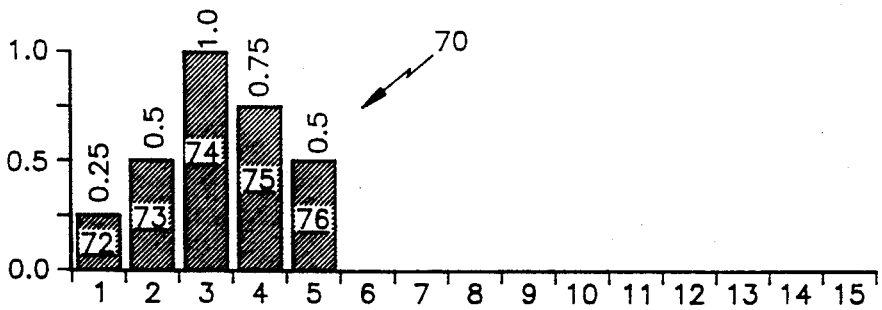
FIGS. 4A and 4B are graphs illustrating a GE fuzzy logic function.
Figure 4B:
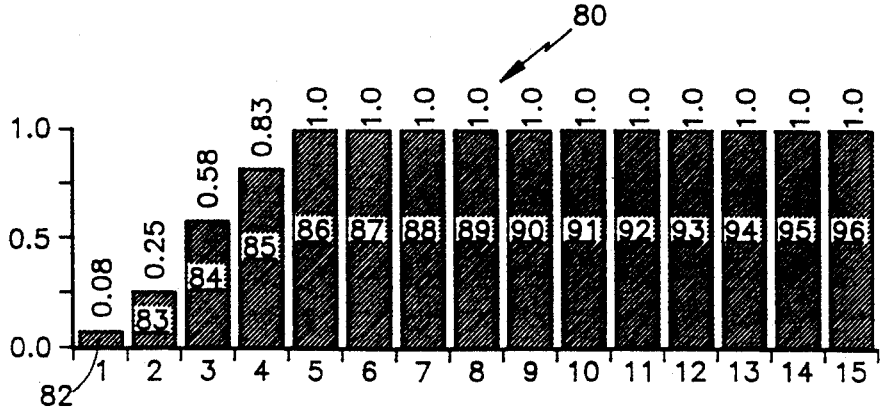

Referring to FIG. 4A, a graph 70 uses a plurality of bars 72–76 to represent a fuzzy set X. The horizontal axis (abscissa) of the graph 70 indicates the basis set (integers from one to fifteen) and the vertical axis (ordinate) indicates the degree of membership of each of the terms. Referring to FIG. 4B, a graph 80 uses a plurality of bars 82–96 to represent a fuzzy set GE[X], wherein the degree of membership of each term indicates the relative likelihood that the value of the term is greater than or equal to the value of a term of X. For example, the bar 83 corresponds to the term of GE[X] having a value of two and a degree of membership of 0.25 indicates that there is a 0.25 relative likelihood that two is greater than or equal to the value of a term in the set of X.

In general, the degree of membership for the with term of GE[X] (i.e., the element having a basis value equal to i) equals the sum of the degrees of membership of elements of X from zero to i divided by the sum of all of the degrees of membership of X. For example, the degree of membership of the term of GE[X] indicated by the bar 85, having a basis value of four, equals the sum of the degrees of membership of all of the terms of X having basis elements ranging from zero to four (0.25+0.5+1.0+0.75) divided by the degrees of membership of all of the terms of X (0.25+0.5+1.0+0.75+0.5). The fuzzy logic functions GT[X], LE[X], and LT[X], which represent greater than X, less than or equal to X, and less than X, respectively, are similarly derived.

The fuzzy logic subtraction operation used herein is also non-standard. For two fuzzy logic sets X and Y, the quantity $Z=X-Y$ is determined by subtracting, one at a time, all of the terms of the Y fuzzy set from all of the terms of the X fuzzy set. Given a term of the X fuzzy set, TX, and a term of the Y fuzzy set, TY, the basis value of the resulting term will be the basis value of TY minus the basis value of TX. The subtraction is only performed if the basis value of TY is less than the basis value of TX. The degree of membership of the result will be the minimum of the degree of membership of TX and the degree of membership of TY. After all of the subtractions have been performed, terms having duplicate basis values are combined into a single term having a degree of membership equal to that of the duplicate term having the maximum degree of membership.

An EVIDENCE[X, Y] function is used herein to combine fuzzy logic sets X and Y in a manner which takes into account the degrees of membership of terms of X and terms of Y. The EVIDENCE function provides a resultant fuzzy set having basis values corresponding to basis values found in both the X and Y fuzzy sets. The degree of membership of a particular term of the resultant fuzzy set equals the product of the degrees of membership of terms of X and Y having the same basis value as the particular term in resultant set.

Another non-standard fuzzy logic function is BETWEEN[X, Y], which provides a fuzzy set indicative of values between fuzzy set X and fuzzy set Y, wherein the degree of membership of a term indicates the relative likelihood that the value of the term is between the value of a term of X and the value of a term of Y. For an inclusive BETWEEN, BETWEEN[X, Y]=GE[X] AND LE[Y]. Similarly, for an exclusive BETWEEN, BETWEEN[X, Y]=GT[X] AND LT[Y]. The inclusive BETWEEN may be used in each instance herein.

Figure 5A:
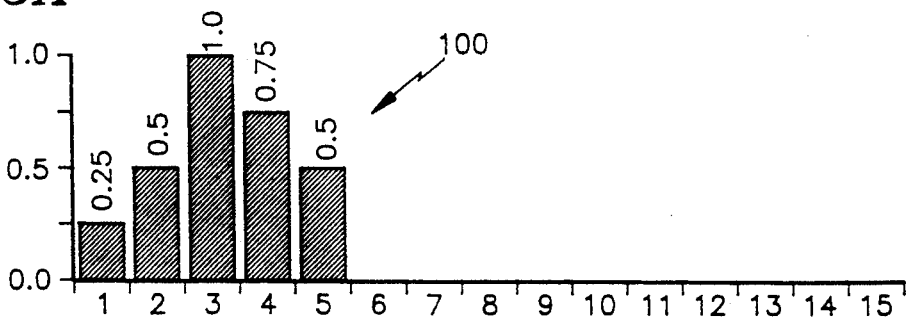
FIGS. 5A, 5B, 5C, and 5D are graphs illustrating BETWEEN and TAPER fuzzy logic functions.
Figure 5B:
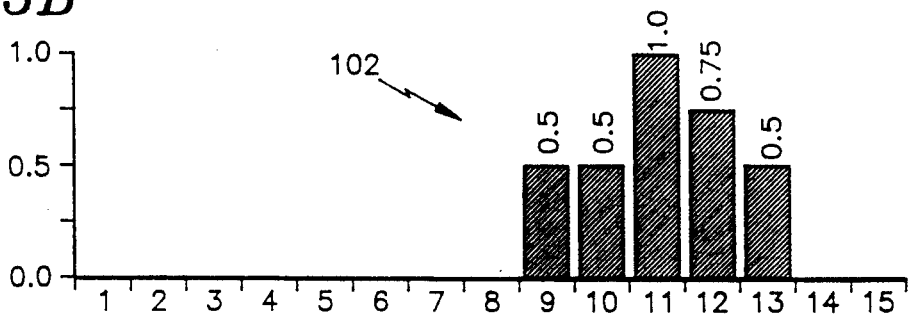
Figure 5C:
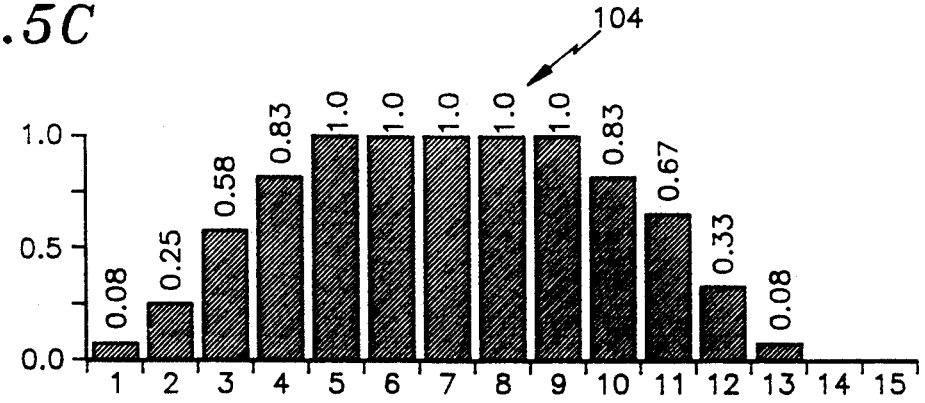

Referring to FIGS. 5A, 5B, and 5C, a first graph 100 represents a fuzzy set X, a second graph 102 represents a fuzzy set Y, and a third graph 104 represents a fuzzy set indicative of BETWEEN[X,Y]. For the graphs 100, 102, 104, the horizontal axes indicate the basis set (integers from one to fifteen) and the vertical axes indicate the degree of membership of each of the terms of the fuzzy sets X and Y and BETWEEN[X,Y].

A TAPER[X,Y] function is analogous to the BETWEEN[X,Y] function, except that terms of the resulting fuzzy set have degrees of membership which are relatively higher for terms having values corresponding to values of terms of X rather than values of terms of Y. The TAPER function is useful when an expected result corresponds to the value of a term of X, but there is a slight possibility that the result could correspond to a value of a term of Y.

Figure 5D:
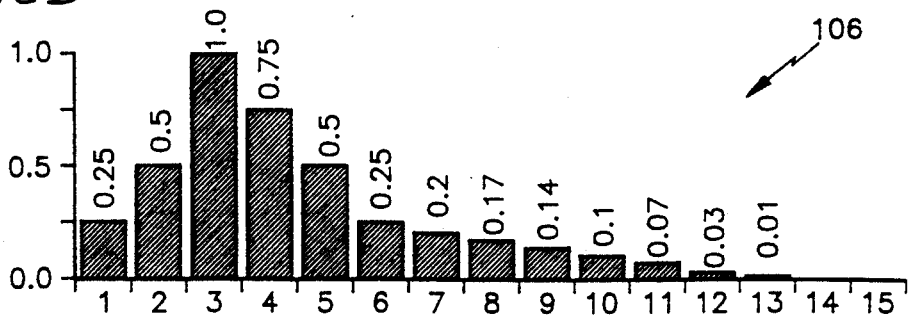

Referring to FIG. 5D, a graph 106 illustrates the result of applying the TAPER function to fuzzy sets X and Y, which correspond to the graphs 100, 102, respectively, described above. The degree of membership of the with term of the resultant fuzzy set equals the following:

$$\mathrm{MAX}[\mathrm{memx},\ (\mathrm{BETWEEN}[X,Y]/(1+|i-\mathrm{XMAX}|))]$$

For the above equation, memx represents the degree of membership of the with term of X and XMAX represents the basis value of the term of X having the highest degree of membership. For example, the graph 100 illustrates that the basis value of the term having the highest degree of membership is three. Note that in the graph 106 the degrees of membership for the first five terms (the terms having values one through five) equal the degrees of membership of terms of the graph 100, which represents X.

Referring to FIG. 6, a flowchart 110 illustrates the steps for determining PENTER and PEXIT, fuzzy logic sets indicative of numbers of passengers entering and exiting from, respectively, the elevator car at a stop. The to embedded elevator controller software corresponding to the flowchart 110 is executed once after the elevator car departs from the stop.

The passenger calculator module 28 calculates three separate temporary estimates of the number of entering passengers: PEN1, PEN2, and PEN3. PEN1 depends upon the state of the HALLCALLS signal (i.e., whether the car stops at the floor in response to a hall call). PEN2 is determined by examining the number of car call buttons which are pressed after the car departs from the stop. PEN3 is based upon the number of passengers in the car before the stop, and the number of passengers in the car after the stop. The passenger calculator module 28 combines the temporary estimates PEN1, PEN2, and PEN3 to form PENEST, a comprehensive estimate of passenger entering the car. PENEST is used to determine PENTER.

Similarly, the passenger calculator module 28 calculates three separate temporary estimates of the number of exiting passengers: PEX1, PEX2, and PEX3. PEX1 depends upon the state of the CARCALLS signal (i.e., whether the car stops at a floor in response to a car call). PEX2 is determined by examining the number of car call buttons which are pressed before the car arrives at the stop. PEX3 is based upon the number of passengers in the car before the stop and the number of passengers in the car after the stop. The passenger calculator module 28 combines PEX1, PEX2, and PEX3 to form PEXEST, a comprehensive estimate of the number of passengers exiting from the car. PEXEST is used to determine PEXIT.

Flow begins at a first step 111 where the state of the HALLCALLS signal is tested. If there is not a hall call at the stop (i.e., the car stops at the floor only in response to a car call), control passes from the step 111 to a step 112, where a first entering fuzzy logic set, PEN1, the first temporary estimate of the number of entering passengers based on the state of the HALLCALLS signal, is set equal to a fuzzy set indicative of TAPER[0-,PAFT]. The first argument to the TAPER function is zero because if an elevator car stops at a floor in response to a car call and there is no hall call at that floor, it is very likely that no one will enter the car at that floor. However, there is a slight possibility that some passengers will be waiting in the hall to get on the car but will have not pressed a hall call button. Therefore, the fuzzy set PEN1 is set to have its membership taper down from a maximum membership for a basis element of zero passengers to a minimum membership for the basis element of PAFT. PAFT is the number of passengers in the car after the car departs from the stop and hence the maximum possible number of entering passengers. The TAPER function thus provides degrees of membership indicating a relatively high likelihood that the number of entering passengers is zero.

If at the test step 111 the HALLCALLS signal indicates a hall call at the stop (floor and direction), control passes from the step 111 to a step 113, where PEN1 is set equal to the fuzzy set representing BETWEEN[F1-,PAFT], where F1 is the fuzzy set ({0.1|0, 1.0|1}. The fuzzy set F1 represents approximately one passenger, with a 0.1 relative likelihood of zero passengers. Setting PEN1 to BETWEEN[F1, PAFT] indicates that the number of entering passengers is generally between one and PAFT.

Control passes from either the step 112 or the step 113 to a step 114, where a second entering fuzzy logic set, PEN2, the second temporary estimate of the number of entering passengers based on the state of the CARCALLS signal, is set equal to OR[TAPER[NC,0], BETWEEN[NC,PAFT]], where NC equals the number of new car calls entered at or immediately after the stop. NC is derived by examining the state of the CARCALLS signal before the stop and after the stop to determine how many new car calls were entered at or immediately after the stop.

The OR function used to determine PEN2 is the maximum memberships of like basis elements, but here, it effectively concatenates (links together) the TAPER and the BETWEEN functions because there is no interaction (no common basis elements) between the TAPER and the BETWEEN fuzzy sets here. BETWEEN[NC, PAFT] is used because it is assumed that the number of entering passengers is usually between NC, the number of new car calls, and PAFT, the number of passengers in the car after the stop. However, it is possible for a passenger to push more than one button. Therefore, the fuzzy set PEN2 tapers (using the TAPER function) from a maximum membership for a basis element of NC down to a minimum membership for zero passengers.

Following the step 114 is a step 115 where a third entering fuzzy logic set, PEN3, is set to BETWEEN[-(PAFT−PBEF), PAFT]. The first argument to the BETWEEN function is PAFT−PBEF, a fuzzy set derived using the rules of fuzzy subtraction, described above, which represents the minimum number of entering passengers. The second argument to BETWEEN, PAFT, is the maximum possible number of entering passengers. The net effect of this is a set having degrees of membership indicating a relatively high likelihood that the number of entering passengers is between (1) the number of passengers in the car after the stop and (2) the difference of the number of passengers in the car before and after the stop.

After the step 115 is a step 116 where the fuzzy sets PEN1, PEN2, and PEN3 are combined to form PENEST, a fuzzy set representing a comprehensive estimate of the number of passengers entering the car. At the step 116, PENEST is set equal to EVIDENCE[PEN3 AND[PEN1 PEN2]] where the AND results in the minimum degree of membership of like basis elements.

Following the step 116 is a test step 117, where the state of the CARCALLS signal is tested. If the car arrives at a stop in response to only a hall call, control passes from the step 117 to a step 118, where a first exiting fuzzy logic set, PEX3 is set equal to TAPER[0, PBEF], indicating that if there is no car call at a stop, it is likely that no passengers exited the car at the stop.

If the result of the test at the step 117 indicates that there is a car call at the stop, control passes from the step 117 to a step 119 where PEX1 is set to BETWEEN[F1, PBEF]. F1 is a fuzzy set equal to {0.1|0, 1.0|1} and represents approximately one passenger. Note that PBEF represents the maximum number of passengers that can exit a car at a stop.

Control passes from either the step 118 or the step 119 to a step 120, where a second exiting fuzzy logic set, PEX2, is set to OR[BETWEEN[0,PBEF−OC], TAPER[PBEF−OC, PBEF]]. OC, representing the number of old car calls, equals the number of car calls registered prior to the stop (not counting a call, if any, for the current stop) and is determined by examining the state of the CARCALLS signal. Using the quantity PBEF−OC assumes that passengers in the car before the stop that pressed car buttons for other stops will not exit the car at the stop. Therefore, PEX2 is set to be between zero and the number of passengers staying on the car. The other argument to the OR function, TAPER [PBEF−OC, PBEF], is used in recognition of the fact that it is possible for one or more passengers to press a car call button for one stop and then exit the car at another stop. The net effect of this is a relatively high likelihood that the number of exiting passengers is between (1) zero and (2) the number of passengers in the car before the stop minus the number of old car calls, and a relatively low likelihood that the number of exiting passengers is the number of passengers in the car before the stop.

Following the step 120 is a step 121, where a third exiting fuzzy logic set, PEX3, is set to BETWEEN[-PBEF−PAFT, PBEF]. PBEF−PAFT is the minimum number of passengers that can exit a car at a stop. PBEF equals the maximum number of passengers that can exit a car at a stop.

After the step 121 is a step 122, where PEXEST, a fuzzy set representing a comprehensive estimate of the number of passengers exiting the car at the stop, is set to EVIDENCE[PEX3, AND[PEX1,PEX2]]. Following the step 122 are three steps 123-125 where PENEST and PEXEST are used to determine PENTER and PEXIT. The steps 123-125 make use of the following equations:

$$PENTER = PAFT - (PBEF - PEXIT)$$

and $$PEXIT = PBEF - (PAFT - PENTER)$$

Both of the above equations indicate that the number of passengers entering and exiting the car is accounted for by the number of passengers in the car before and after the stop.

At the step 123, a fuzzy set PEXIT is set equal to PBEF−(PAFT−PENEST). The rules of fuzzy subtraction, described above, are used. At the next step 124, PENTER is set to PAFT−(PBEF−AND[PEXEST, PEXIT]); using both available values of existing passengers makes the value more accurate. The last step 125 where PEXIT is set to PBEF−(PAFT−PENTER), is used to ensure that the final results for PENTER and PEXIT are in accord with the values for PBEF and PEXIT.

The invention illustrated herein may be adapted by one skilled in the art to work with crisp, rather than fuzzy, inputs including the PBEF and PAFT inputs. Similarly, the invention may be used only for determining the number of entering passengers or only for the number of exiting passengers. The particular operations of the BETWEEN, EVIDENCE, TAPER, and fuzzy subtraction functions may be modified by one skilled in the art without departing from the spirit and scope of the invention. The invention may be practiced irrespective of the order used to determine the temporary estimates for the number of entering or exiting passengers. Also, the invention may be practiced using other input criteria, such as the amount of time that the elevator car doors are held open.

The invention illustrated herein is applicable to any elevator system having any number of cars, stopping on any number of floors, having any maximum capacity, maximum velocity, or having any other specific set of physical characteristics. Similarly, the invention may be practiced irrespective of the physical design of the elevator system, including drives, counterweights, cabling, door mechanisms, hall call and car call signaling devices, etc.

Furthermore, the invention may be practiced irrespective of the processes used to carry out the follow-on elevator dispatching functions, the specific electronic hardware used to implement the invention, or the design of the load weighing device. Portions of the processing illustrated herein may be implemented with electronic hardware instead of software, which would be straightforward in view of the hardware/software equivalence discussed (in another field) in U.S. Pat. No. 4,294,162 entitled "Force Feel Actuator Fault Detection with Directional Threshold" (Fowler et. al.). Instead of reading and writing data to and from data elements, the hardware would communicate by receiving and sending electronic signals.

Although only run-time operation of the passenger calculator module 28 is illustrated herein, the module 28 may be run off-line to generate lookup tables containing all of the possible inputs and the resulting outputs.

Although the invention has been shown and described with respect to exemplary embodiments thereof, it should be understood by those skilled in the art that various changes, omissions and additions may be made therein and thereto, without exiting from the spirit and the scope of the invention.

What is claimed is:

1. A method of dispatching a plurality of elevator cars in a building, including determining the number of passengers entering an elevator car at a stop, comprising the steps of:

forming a first entering fuzzy logic set having basis elements corresponding to numbers of passengers and either having degrees of membership indicating a relative likelihood that the number of entering passengers is between one and the number of passengers in the car after the stop in response to a hall call button having been pressed at the stop or otherwise having degrees of membership indicating a relatively high likelihood that the number of entering passengers is zero;

forming a second entering fuzzy logic set having basis elements corresponding to numbers of passengers and having degrees of membership indicating a relatively high likelihood that the number of entering passengers is between the number of new car calls and the number of passengers in the car after the stop and a relatively low likelihood that the number of entering passengers is between zero and the number of new car calls;

forming a third entering fuzzy logic set having basis elements corresponding to numbers of passengers and having degrees of membership indicating a relatively high likelihood that the number of entering passengers is between the number of passengers in the car after the stop and the difference of the number of passengers in the car before and after the stop;

combining said first, second, and third fuzzy logic sets to form a fuzzy logic set indicative to the number of entering passengers at a stop; and dispatching elevator cars according to a process utilizing said fuzzy logic set indicative of the number of entering passengers at a stop.

2. A method of dispatching a plurality of elevator cars in a building, including determining the number of passengers exiting an elevator car at a stop, comprising the steps of:

forming a first exiting fuzzy logic set having basis elements corresponding to numbers of passengers and either having degrees of membership indicating a relative likelihood that the number of exiting passengers is between one and the number of passengers in the car before the stop in response to a car call button having been pressed for the stop or otherwise having degrees of membership indicating a relatively high likelihood that the number of exiting passengers is zero;

forming a second exiting fuzzy logic set having basis elements corresponding to numbers of passengers and having degrees of membership indicating a relatively high likelihood that the number of exiting passengers is between zero and the number of passengers in the car before the stop minus the number of old car calls and a relatively low likelihood that the number of exiting passengers is the number of passengers in the car before the stop;

forming a third exiting fuzzy logic set having basis elements corresponding to numbers of passengers and having degrees of membership indicating a relatively high likelihood that the number of exiting passengers is between the number of passengers in the car before the stop and the difference of the number of passengers in the car after and before the stop;

combining said first, second, and third fuzzy logic sets to form a fuzzy logic set indicative of the number of exiting passengers at a stop; and dispatching elevator cars according to a process utilizing said fuzzy set indicative of the number of exiting passengers at a stop.

3. A method of dispatching a plurality of elevator cars in a building including determining the number of passengers entering and exiting an elevator car at a stop, comprising the steps of:

forming a first entering fuzzy logic set having basis elements corresponding to numbers of passengers and either having degrees of membership indicating a relative likelihood that the number of entering passengers is between one and the number of passengers in the car after the stop in response to a hall call button having been pressed at the stop or otherwise having degrees of membership indicating a relatively high likelihood that the number of entering passengers is zero;

forming a second entering fuzzy logic set having basis elements corresponding to numbers of passengers and having degrees of membership indicating a relatively high likelihood that the number of entering passengers is between the number of new car calls and the number of passengers in the car after the stop and a relatively low likelihood that the number of entering passengers is between zero and the number of new car calls;

forming a third entering fuzzy logic set having basis elements corresponding to numbers of passengers and having degrees of membership indicating a relatively high likelihood that the number of entering passengers is between the number of passengers in the car after the stop and the difference of the number of passengers in the car before and after the stop;

combining said first, second, and third entering fuzzy logic sets to form a fuzzy logic set indicative of the number of entering passengers at a stop;

forming a first exiting fuzzy logic set having basis elements corresponding to numbers of passengers and either having degrees of membership indicating a relative likelihood that the number of exiting passengers is between one and he number of passengers in the car before the stop in response to a car call button having been pressed for the stop or otherwise having degrees of membership indicating a relatively high likelihood that the number of exiting passengers is zero;

forming a second exiting fuzzy logic set having basis elements corresponding to numbers of passengers and having degrees of membership indicating a relatively high likelihood that the number of exiting passengers is between zero and the number of passengers in the car before the stop minus the number of old car calls and a relatively low likelihood that the number of exiting passengers is the number of passengers in the car before the stop;

forming a third exiting fuzzy logic set having basis elements corresponding to numbers of passengers and having degrees of membership indicating a relatively high likelihood that the number of exiting passengers is between the number of passengers in the car before the stop and the difference of the number of passengers in the car after and before the stop;

combining said first, second and third exiting fuzzy logic sets to form a fuzzy logic set indicative of the number of exiting passengers at a stop; and dispatching elevator cars according to a process utilizing said fuzzy logic set indicative of the number of entering passengers at a stop and said fuzzy logic set indicative of the number of exiting passengers at a stop.

4. A method according to claim 3 including providing a final exiting fuzzy set indicative of exiting passengers and a final entering fuzzy set indicative of entering passengers in response to said fuzzy logic set indicative of entering passengers, said fuzzy logic set indicative of exiting passengers, the number of passengers in the car before the stop, and the number of passengers in the car after the stop; and dispatching elevator cars according to a process utilizing said final exiting fuzzy set and said final entering fuzzy set.

* * * * *